US010253930B2

(12) United States Patent
Den Boer

(10) Patent No.: US 10,253,930 B2
(45) Date of Patent: Apr. 9, 2019

(54) LIGHTING DEVICE WITH FOLDABLE HOUSING

(71) Applicant: PHILIPS LIGHTING HOLDING B.V., Eindhoven (NL)

(72) Inventor: Reinier Imre Anton Den Boer, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/110,411

(22) PCT Filed: Jan. 20, 2015

(86) PCT No.: PCT/EP2015/050912
§ 371 (c)(1),
(2) Date: Jul. 8, 2016

(87) PCT Pub. No.: WO2015/107204
PCT Pub. Date: Jul. 23, 2015

(65) Prior Publication Data

US 2016/0334065 A1 Nov. 17, 2016

(30) Foreign Application Priority Data

Jan. 20, 2014 (EP) ..... 14151793

(51) Int. Cl.
*F21K 9/23* (2016.01)
*F21K 9/90* (2016.01)
(Continued)

(52) U.S. Cl.
CPC ..... *F21K 9/237* (2016.08); *F21K 9/23* (2016.08); *F21K 9/232* (2016.08); *F21K 9/235*
(Continued)

(58) Field of Classification Search
CPC ..... F21V 17/107; F21V 3/0436; F21K 9/238; F21K 9/237; F21K 9/232; F21S 4/10
See application file for complete search history.

(56) References Cited

U.S. PATENT DOCUMENTS 1,435,002 A * 11/1922 Goodwin ..... F21S 48/1216 362/294
3,258,589 A * 6/1966 Doring ..... A63H 33/22 362/186
(Continued)

FOREIGN PATENT DOCUMENTS

CN 202302834 U 7/2012
JP 2003297110 A 10/2003
(Continued)

OTHER PUBLICATIONS

Xiamen Xiexinglong Plastic Co., Ltd., "Clamshell Packaging for LED Lamp and Custom Design", alibaba.com, Mar. 27, 2013, 1 page.

*Primary Examiner* — Alexander K Garlen
*Assistant Examiner* — Colin J Cattanach
(74) *Attorney, Agent, or Firm* — Akarsh P. Belagodu

(57) ABSTRACT

A method for manufacturing a lighting device (100), the method comprising the steps of providing (S1) a sheet of optically transmissive plastic material, forming (S2) a lighting device housing from the sheet of optically transmissive plastic material, such that the lighting device housing comprises a first portion (212) connected to a second portion (214) by a flexible connecting portion (202), folding (S3) the first (212) or second portion (214) about the flexible connecting portion (202) to enclose a light source (210) and driver electronics (206) within an enclosed region of the lighting device housing, and securing (S4) the first portion
(Continued)

(212) to the second portion (214) such that the lighting device housing maintains the folded position.

18 Claims, 4 Drawing Sheets

(51) Int. Cl.

| | |
|---|---|
| ***F21V 3/06*** | (2018.01) |
| ***F21V 9/30*** | (2018.01) |
| ***F21K 9/232*** | (2016.01) |
| ***F21K 9/235*** | (2016.01) |
| ***F21K 9/237*** | (2016.01) |
| ***F21K 9/238*** | (2016.01) |
| ***F21V 15/01*** | (2006.01) |
| ***F21V 17/00*** | (2006.01) |
| ***F21V 17/10*** | (2006.01) |
| ***F21V 19/00*** | (2006.01) |
| ***F21V 23/00*** | (2015.01) |
| ***F21V 23/02*** | (2006.01) |
| ***F21V 29/70*** | (2015.01) |
| ***F21V 29/507*** | (2015.01) |
| ***F21Y 103/33*** | (2016.01) |
| ***F21Y 105/10*** | (2016.01) |
| ***F21Y 115/10*** | (2016.01) |

(52) U.S. Cl.

CPC ..... (2016.08); *F21K 9/238* (2016.08); *F21K 9/90* (2013.01); *F21V 3/062* (2018.02); *F21V 15/01* (2013.01); *F21V 17/107* (2013.01); *F21V 19/006* (2013.01); *F21V 23/006* (2013.01); *F21V 23/009* (2013.01); *F21V 23/02* (2013.01); *F21V 29/70* (2015.01); *F21V 3/0625* (2018.02); *F21V 9/30* (2018.02); *F21V 15/013* (2013.01); *F21V 17/007* (2013.01); *F21V 29/507* (2015.01); *F21Y 2103/33* (2016.08); *F21Y 2105/10* (2016.08); *F21Y 2115/10* (2016.08)

(56) References Cited

U.S. PATENT DOCUMENTS 3,814,927 A * 6/1974 Buzza ..... F21L 14/02 362/296.07
4,425,602 A * 1/1984 Lansing ..... A45B 3/04 362/102
4,731,716 A * 3/1988 Chang ..... F21V 1/06 362/352
4,847,741 A * 7/1989 Boettinger ..... A01G 7/045 362/122
5,083,251 A * 1/1992 Parker ..... F21V 17/04 362/255
5,517,395 A * 5/1996 Weissman ..... F21V 31/005 116/63 R
5,567,045 A * 10/1996 Bucek ..... F21V 3/00 362/363
6,621,222 B1 * 9/2003 Hong ..... F21V 3/02 315/272
6,786,621 B2 * 9/2004 Sviland ..... F21V 1/16 362/237
7,220,024 B1 * 5/2007 Berends ..... F21L 14/02 362/109
8,870,406 B2 * 10/2014 Ruriani ..... H01J 61/327 362/217.1
2005/0185400 A1 * 8/2005 Hsu ..... F21S 4/10 362/238
2006/0034078 A1 * 2/2006 Kovacik ..... F21L 4/08 362/227
2006/0034091 A1 * 2/2006 Kovacik ..... F21L 14/023 362/398
2007/0267976 A1 * 11/2007 Bohler ..... B82Y 10/00 315/112
2007/0291497 A1 * 12/2007 Haddad ..... F21S 8/086 362/427
2008/0298058 A1 12/2008 Kan et al.
2011/0044057 A1 * 2/2011 Foo ..... F21S 48/115 362/311.02
2011/0080742 A1 * 4/2011 Allen ..... F21V 3/00 362/294
2011/0215696 A1 * 9/2011 Tong ..... F21K 9/00 313/46
2011/0242823 A1 * 10/2011 Tracy ..... F21V 3/02 362/351
2011/0292651 A1 * 12/2011 Kovacik ..... F21L 14/023 362/235
2012/0014086 A1 * 1/2012 Jonsson ..... F21K 9/56 362/84
2012/0069570 A1 * 3/2012 Marinus ..... F21V 3/02 362/249.02
2012/0162988 A1 * 6/2012 Marinus ..... F21V 3/02 362/249.02
2013/0051002 A1 2/2013 Draper et al.
2013/0107496 A1 * 5/2013 Bisberg ..... F21V 29/02 362/84
2013/0175556 A1 * 7/2013 Ray ..... H01L 33/56 257/88
2013/0286645 A1 10/2013 Bukkems et al.
2014/0043832 A1 * 2/2014 Ruriani ..... H01J 61/327 362/372
2015/0048759 A1 * 2/2015 Jo ..... F21V 29/83 315/297

FOREIGN PATENT DOCUMENTS

JP 2011060428 A 3/2011
JP 20124392 A 1/2012
WO WO2008134424 A2 11/2008
WO WO2013082223 A1 6/2013

* cited by examiner

LIGHTING DEVICE WITH FOLDABLE HOUSING

CROSS-REFERENCE TO PRIOR APPLICATIONS

This application is the U.S. National Phase application under 35 U.S.C. § 371 of International Application No. PCT/EP2015/050912, filed on Jan. 20, 2015, which claims the benefit of European Patent Application No. 14151793.8, filed on Jan. 20, 2014. These applications are hereby incorporated by reference herein.

FIELD OF THE INVENTION

The invention relates to a lighting device. In particular, the invention relates to an improved lighting device and a method for manufacturing an improved lighting device.

BACKGROUND OF THE INVENTION

The development of new and more energy efficient illumination devices is one of the important technical challenges which society faces. Common technologies which are more energy efficient than traditional lighting solutions are often based on Light Emitting Diodes (LEDs). Currently, the reduced driving cost and improved performance of LEDs enable their use for general illumination. However, to reach widespread mass market proliferation it would be desirable to reduce manufacturing costs for lighting devices designed as retrofits for current lighting devices, such as incandescent bulbs and tube lighting. Retrofitable lighting devices using LEDs are currently available to the public, however the prices of such devices are larger than they are for traditional lighting devices, hence the general public might still be more inclined to buy a traditional lighting device. Further, since a lighting device using LEDs is inherently more complex than an ordinary lighting device, partly due to the driver electronics needed to convert grid electricity into a level for driving LEDs, it is hard to sort and recycle lighting devices using LEDs.

Thus there is a need to reduce the costs for lighting devices using LEDs to make them more available. Further it would also be desirable to make these devices easier to recycle.

SUMMARY OF THE INVENTION

It is a general object of the present invention to enable a lower manufacturing cost and easier recycling for a lighting device comprising LEDs.

According to a first aspect of the invention, these and other objectives are achieved by a lighting device comprising a lighting device housing formed in an optically transmissive plastic material, a light source arranged within the lighting device housing, driver electronics configured to drive the light source, arranged within the lighting device housing, wherein the lighting device housing comprises a first housing portion and a second housing portion connected to each other by a flexible connecting portion, the first housing portion being configured to be folded about the flexible connecting portion to enclose the light source and the driver electronics within the lighting device housing, and means for securing the first housing portion to the second housing portion to maintain the lighting device housing in a folded position.

By lighting device it should be understood that the purpose of the device is to provide lighting, and that the light source, which is commonly one or several LEDs is the main component providing the light.

The lighting device housing is formed in an optically transmissive plastic material such that when the lighting device is in use, light emitted by the light source arranged within the lighting device housing is able to pass through said lighting device housing.

The driver electronics should be understood as the electronic components required to drive a solid state light source such as an LED, hence examples of such components and circuits are typically able to create a direct current from an alternating current and also to convert the voltage from a household socket to a voltage suitable for driving the solid state light source which is used.

The lighting device housing comprises a first and a second portion connected by a flexible connecting portion, by this design the components may be arranged within either the first or the second portion using fewer steps of manufacturing than ordinarily possible. Furthermore, the lighting device housing is formed in one piece, thereby also reducing the number of steps required to form the lighting device housing. The lighting device may be understood as a clamshell design where the components are placed in one of the shell halves of the lighting device housing, after which the other shell half of the lighting device housing is folded about the flexible connecting portion such that the lighting device housing encloses the components, thus forming a lighting device. Moreover, the shell halves of the lighting device housing are secured to each other by securing means to ensure that the lighting device is kept closed during use.

The present invention is based on the realization that by providing a lighting device housing comprising a first and a second portion connected by a flexible connecting portion, components of the lighting device are thus allowed to be arranged in one of the portions prior to closing the lighting device housing, therefore a lighting device is provided that saves costs for material and energy and reduces the numbers of steps needed during production. Furthermore, such a lighting device enables easier recycling such that recycling of components therein is made possible by opening the lighting device housing.

According to one embodiment of the invention, the optically transmissive plastic material may be thermo formable. By using a thermo formable material, it is possible to form the lighting device housing using thermo forming production techniques which are known methods for mass production. Thereby, the lighting device housing can be produced in large quantities, and thus enable a highly cost-effective lighting device. Examples of materials which can be used for this purpose and that fit to role-fed high volume thermo forming production machines are PC, PETG, PETA and/or PVC which typically have a thickness of 2 mm or less.

According to another embodiment of the invention, the optically transmissive material may be transparent. The amount of light emitted from the light source which is provided for lighting, i.e. through the lighting device housing, is preferably maximized. Therefore the optically transmissive lighting material is advantageously substantially transparent, in order to increase the amount of light transmitted through the lighting device housing.

According to another embodiment of the invention, the lighting device may further comprise a heat spreader arranged within the lighting device housing and configured to conduct heat from the light source and/or driver electronics to the lighting device housing. The light source and/or driver electronics will, in use, produce heat. By providing a heat spreader arranged within the lighting device housing, the heat is conducted to the lighting device housing which then conducts the heat to the environment surrounding the lighting device. Thereby, the light source and/or driver electronics can be kept at better operating conditions i.e. at a lower temperature.

Accordingly, the heat spreader may comprise a heat conducting foil and/or a preformed heat conductive element. By using a heat conducting foil it is possible to place the heat spreader on the transparent plastic sheet prior to thermo forming, thereby reducing the number of steps during production of the lighting device. Further, the heat conducting foil may be allowed to reach its final shape only when the lighting device housing is closed. A preformed heat conductive element can be applied after the thermo forming, thereby allowing for customization of the device prior to applying the heat spreader. Moreover a graphite heat conductive film or coating may be applied to increase the heat conduction from the heat spreader to the lighting device housing, alternatively the heat spreader comprises a graphite heat conductive film.

According to one embodiment of the invention, the means for securing may comprise an ultrasonic weld, a thermal weld, a snap fitting or a deformation fitting. The means for securing will ensure that the lighting device housing is securely closed. It is furthermore desirable that the means for securing are usable in a mass production facility. Hence an ultrasonic weld, a thermal weld, a snap fitting or deformation fitting is advantageously used. According to one example where the lighting device is recyclable, the snap fitting is desirably used such that the device is able to be opened, or the fixation can be torn away by including a perforation such that the edge is able to be torn away, thereby each component may be separated manually to perform waste sorting and recycling of the electronic components of the lighting device. The deformation fitting is similar to the snap fitting, wherein the means for securing the lighting device housing is deformed in order to secure the first portion to the second portion.

According to another embodiment of the invention, the lighting device housing may comprise diffusing elements configured to scatter light propagating through the lighting device housing. The spatial light distribution from the light source may be non-uniform, this may be due to the light source being a point-like source or due to the non-uniform luminance produced by the light source. For general lighting a diffuse and spatially uniform lighting is appreciated by humans. Hence, providing diffusing elements in order to scatter the light emitted by the light source which propagates through the lighting device housing is desirable.

According to one embodiment of the invention, the lighting device housing may comprise wavelength converting material. A wavelength converting material converts light from a first wavelength to a second wavelength, it should be noted that this conversion may also be a first plurality of wavelengths (i.e. a first spectrum) into a second plurality of wavelengths (i.e. a second spectrum). Indoor lighting with a softer warm white appearance is generally more appreciated by humans. Presently used light sources tend to emit light located towards the blue end of the visible spectrum. Hence, the light emitted by the light source may advantageously be wavelength converted to a more desirable wavelength. The wavelength converting material is typically provided in the form of a luminescent material comprising for example phosphor or quantum dots.

According to another embodiment of the invention, the diffusing elements and/or wavelength converting material may be provided in the form of a pattern printed on the optically transmissive plastic material, a film laminated on the optically transmissive plastic material and/or a material co-extruded with the optically transmissive plastic material. By pre-printing a pattern on the optically transmissive plastic material, a desirable pattern that provides the look and feel appropriate for a lighting device that is a retrofit for ordinary light bulbs and the like is possible. Further, a laminated film and a co-extruded material can be combined with steps of mass production whereby a cheap and customized lighting device will be provided.

According to one embodiment of the invention the lighting device housing may further comprise a removable hanger portion. By including a removable hanger portion as part of the lighting device housing, the lighting device according to the present invention will not need a package when being offered for sale, thus further increasing the environmental benefits and also reducing the cost through eliminating the need for packaging. The hanger portion is removable in order to allow the buyer of the device to remove the hanger portion prior to using the lighting device.

According to another embodiment of the invention, the lighting device housing may further comprise at least one assembly aid portion configured to hold the light source and/or the driver electronics. The assembly aid portions will hold the light source and/or driver electronics during assembly of the lighting device, thereby alleviating the need for glue or outer types of fixture during assembly.

According to another embodiment of the invention, the lighting device housing may comprise a plurality of housing portions, and where each of the plurality of housing portions may be connected to an adjacent housing portion by a flexible connecting portion. The lighting device housing can comprise a plurality of housing portions, whereby it is possible to enclose the light source and driver electronics by folding one housing portion after another. Thus, each flexible connecting portion which connects adjacent housing portions will be bent at a smaller angle and therefore allowing the use of a thicker material and/or other materials.

According to various embodiments of the invention, the lighting device further comprises a base portion connected to the driver electronics and configured to connect the lighting device to a power source.

According to a second aspect of the present invention the objects are also achieved by using a method for manufacturing a lighting device, the method comprising the steps of providing a sheet of optically transmissive plastic material, forming a lighting device housing from the sheet of optically transmissive plastic material, such that the lighting device housing comprise a first portion connected to a second portion by a flexible connecting portion, folding the first or second portion about the connecting portion to enclose a light source and driver electronics within an enclosed region of the lighting device housing, and securing the first portion to the second portion such that the lighting device housing maintains the folded position.

By forming the lighting device housing in one piece from the sheet of optically transmissive plastic material, thus comprising the first portion, the second portion and the flexible connecting portion, a short and straightforward production process of forming the lighting device housing is provided. Furthermore, manufacturing the lighting device housing from one piece decreases the number of components requiring handling during assembly compared to if each portion of the lighting device housing is provided as a separate piece. Moreover, by enabling the folding of the first or second portion about the connecting portion, the components of the lighting device such as a light source and driver electronics may be arranged within the lighting device housing prior to the step of folding, thereby alleviating the need for a fixture or the like for handling of these components during production.

Further effects and features of this second aspect of the present invention are largely analogous to those described above in connection with the first aspect of the invention.

Further features of, and advantages with, the present invention will become apparent when studying the appended claims and the following description. For example the light source may be a different light generator such as e.g. lasers, flash lamps, Xenon lamps or even X-ray sources. The skilled person realize that different features of the present invention may be combined to create embodiments other than those described in the following, without departing from the scope of the present

BRIEF DESCRIPTION OF THE DRAWINGS

This and other aspects of the present invention will now be described in more detail, with reference to the appended drawings showing an embodiment of the invention.

DETAILED DESCRIPTION OF EXAMPLE EMBODIMENTS OF THE INVENTION

In the present detailed description, various embodiments of a lighting device according to the present invention are mainly discussed with reference to a lighting device comprising light emitting diodes (LEDs) as a light source. It should be noted that this by no means limits the scope of the invention, which is also applicable in other circumstances, for example for use with other types of light sources. Moreover the number of LEDs shown in the enclosed drawings is only a schematic representation. In use, the arrangement, number of LEDs and other such details will be decided by each application.

Figure 1:
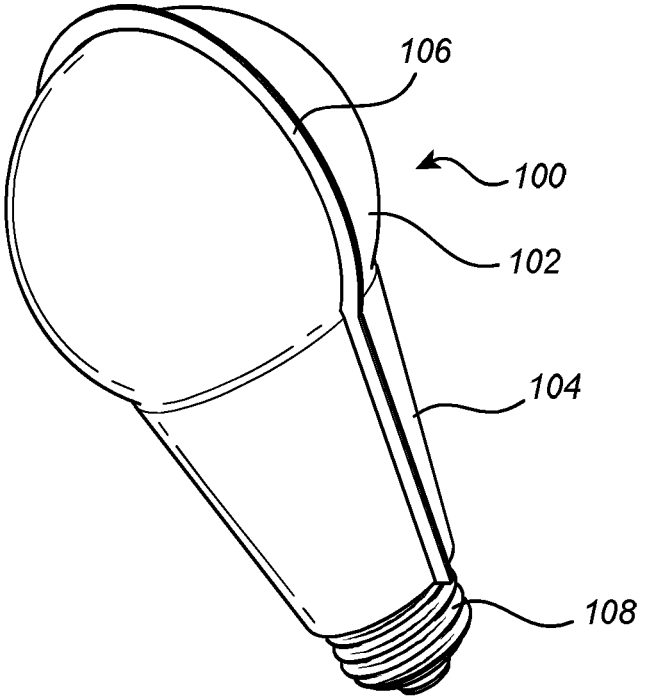
FIG. 1 is a perspective view of a lighting device according to an embodiment of the invention.

FIG. 1 is a perspective view of a lighting device 100 according to the present invention, therein embodied in the shape of a light bulb. The lighting device 100 comprises a bulb portion 102 and a socket portion 104, the socket portion 104 further comprises a base portion 108 by which the lighting device 100 may be fitted to an ordinary lighting fixture, for example an E14 or E27 Edison screw base for light bulbs. The base portion 108 is connected to the driver electronics of the lighting device, and is thereby able to connect the lighting device 100 to a power source. The base portion 108 of FIG. 1 is shaped as a screw base, however any shape or configuration whereby the lighting device 100 may be connected to a power source is within the scope of the invention such as a bayonet fixing with one or several plugs. Further shown in FIG. 1 is also the means for securing 106 whereby the portions of the lighting device housing have been secured to each other to maintain the bulb in a closed position.

Figure 2:
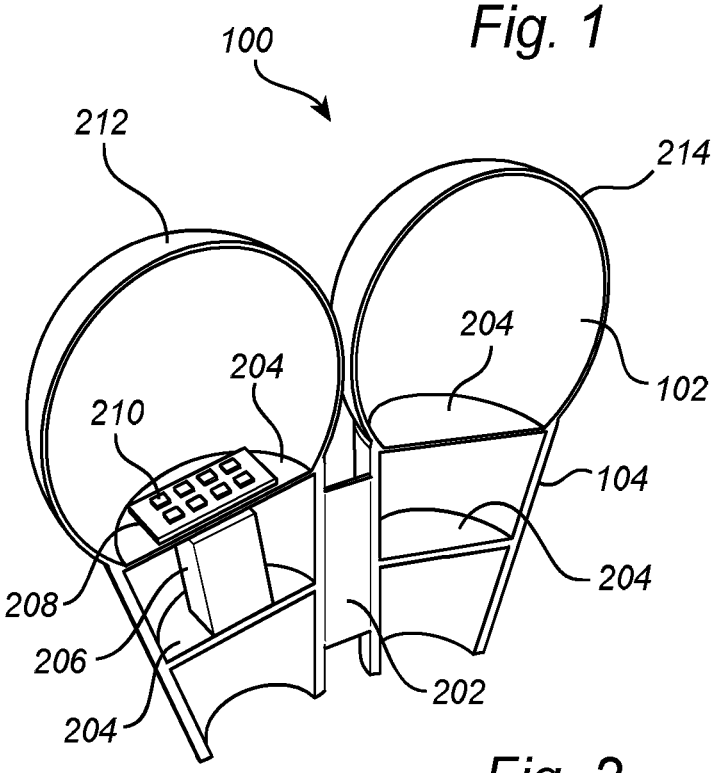
FIG. 2 is a schematic side view of a lighting device according to an embodiment of the invention.

Referring now to FIG. 2, the lighting device 100 will be explained in more detail, shown in FIG. 2 is a schematic side view of an unfolded lighting device 100 according to the present invention. The lighting device 100 comprises a lighting device housing which comprises a first 212 and a second housing portion 214, the housing portions are connected by a flexible connecting portion 202. The flexible connecting portion 202 is flexible by merit of the material of which it is made or could optionally comprise perforations (not shown) to further enable the folding about the flexible connecting portion 202. The lighting device housing is formed in an optically transmissive plastic material, which is preferably thermo formable. Examples of materials which can be used for this purpose and that are suitable for role-fed high volume thermo forming production machines are PC, PETG, PETA and/or PVC which typically have a thickness of 2 mm or less. In FIG. 2 the light source, in this case a printed circuit board 208 (PCB) with mounted light emitting diodes 210 (LEDs) is shown placed in the first housing portion 212, the LEDs 210 are placed such that they, in use, emit light within the bulb portion 102 of the lighting device. Furthermore, the driver electronics 206 are also arranged in the first housing portion 212. It should be noted that the PCB 208 with LEDs 210 as well as the driver electronics 206 could just as well be placed in the second housing portion 214. The first 212 and/or second housing portion 214 may also comprise assembly aid portions 204 for holding the driver electronics 204 and PCB 208 during assembly, reducing or removing the need for manipulation or securing by glue or other types of fixtures these components during assembly of the lighting device 100. The assembly aid portions 204 in FIG. 2 are embodied as walls, however any type of geometrical representation is possible and within the scope of the invention including assembly aid portions 204 which are shaped complimentary with respect to the PCB 208 and the driver electronics 206.

Figure 3:
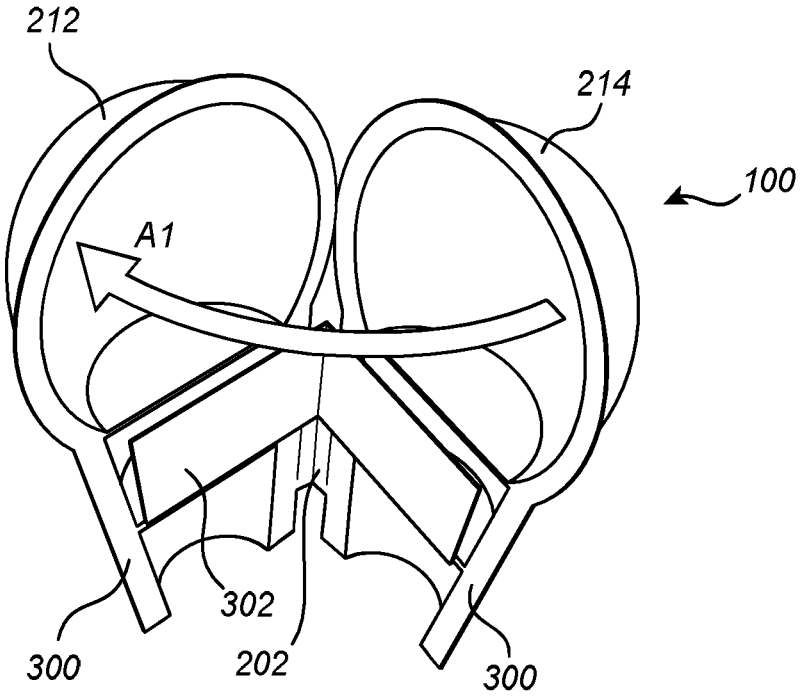
FIG. 3 is a schematic side view of a lighting device according to an embodiment of the invention.

FIG. 3 is a schematic side view of an unfolded lighting device 100 according to an embodiment of the present invention. Compared to FIG. 2 the means for securing 300 the first portion 212 and the second portion 214 are also shown, the means for securing 300 may comprise at least one of; an ultrasonic weld, a thermal weld, snap fitting or deformation fitting. The means for securing 300 will ensure that the lighting device housing is securely closed, further it is desirable that the means for securing should be usable in a mass production facility, thus the means for securing can comprise a ultrasonic weld or thermal weld which is applied after the second housing portion 214 has been folded as indicated by the arrow A1, or alternatively a snap fitting could be used where the action of closing the second housing portion 214 over the first housing portion 212 with sufficient force will securely hold the first and second housing portions together. Similarly to the snap fitting a deformation fitting will use force to deform the means for securing into holding the first housing portion 212 to the second housing portion 214. In FIG. 3 the lighting device 100 further comprises a heat spreader 302, therein embodied by a heat conducting foil. The heat conducting foil 302 will, in use, conduct heat from the PCB 208 and driver electronics 206, which are arranged after the heat conducting foil 302, to the lighting device housing. The lighting device housing will conduct heat through the optically transmissive material to the surrounding environment. The heat conducting foil 302 will reach its final shape when the lighting device housing is folded, about the flexible connecting portion 202, as indicated by the arrow A1 and secured with the means for securing 300. In the embodiment shown in FIG. 3 the heat spreader 302 is as noted, a heat conducting foil 302. However, it is also possible to use a preformed heat conducting element which is placed in the lighting device housing prior to the PCB 208 and driver electronics 206. Alternatively, the heat spreader 302 may comprise a graphite heat conducting film or coating which is applied to further increase the heat conduction from the heat spreader 302 to the lighting device housing.

Figure 4:
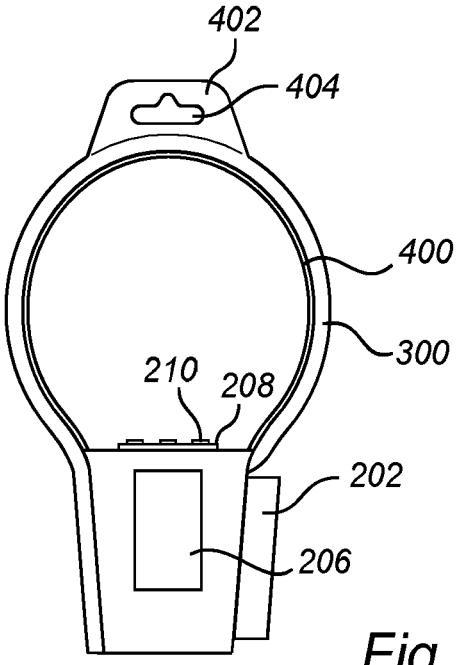
FIG. 4 is a cross-section of a lighting device according to an embodiment of the invention.

Referring now to FIG. 4, a cross-section of a lighting device according to the present invention where the lighting device housing further comprises a removable hanger portion 402 is shown. The removable hanger portion 402 comprises a hole 404, which in FIG. 4 has an elongated shape, however the shape of the hole 404 may be any shape which allows the lighting device 100 to be hanged and as such provide its own hanging function in e.g. a store. The removable hanger portion 402 is removable through bending or through perforations (not shown) so that a user of the lighting device may remove the removable hanger portion 402 with a small or minimal amount of force. In the embodiment shown in FIG. 4 the lighting device 100 further comprises a layer 400, which may comprise diffusing elements configured to scatter light passing through the lighting device housing. The LEDs 210 may be viewed as point sources of light, hence it is beneficial to scatter the light which propagates through the lighting device housing and is emitted from the lighting device 100 in order to make the spatial distribution of emitted light more uniform. Furthermore, the layer 400 may also comprise a luminescent material which wavelength converts the light, for example a material comprising phosphors or quantum dots. The luminescent material 400 will wavelength convert light which is emitted from the LEDs 210 in order to make the spectrum of light emitted from the lighting device 100 aesthetically pleasant or allow a certain distribution on wavelengths such as a warmer white appearance which is appropriate for general indoor lighting.

Figure 5:
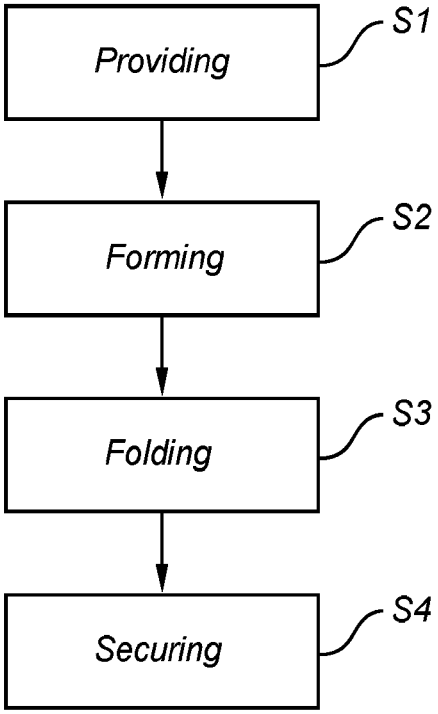
FIG. 5 is a flow chart for a method of manufacturing a lighting device according to an embodiment of the invention.

In FIG. 5 a flow chart for manufacturing a lighting device according to an embodiment of the invention is shown. In step S1 a sheet of optically transmissive plastic material is provided. The optically transmissive material may be PC, PETG, PETA and/or PVC, with a typical thickness of 2 mm or less. The sheet of optically transmissive material may as an alternative be pre-printed, co-extruded or laminated to enable certain effects such as diffusion or wavelength conversion of light which propagates through the material.

Then in step S2, a lighting device housing is formed from the sheet of optically transmissive plastic material, the lighting device housing comprises a first housing portion 212 and a second housing portion 214 which are connected by a flexible connecting portion 202. The lighting device housing is according to various embodiments formed using thermo forming, whereby the sheet of optically transmissive material is heated and a mold of is applied to form the sheet into the shape of the lighting device housing. The flexible connecting portion 202 may comprise perforations to increase the flexibility.

In step S3 the first 212 or the second housing portion 214 is folded about the flexible connecting portion 202 in order to enclose a light source 210 and driver electronics 206. Prior to which the aforementioned heat spreader 302 can be arranged in the lighting device housing in order to conduct heat from the light source 210 and/or the driver electronics 206 to the lighting device housing.

Then in step S4, the first housing portion 212 is secured to the second housing portion 214 by the means for securing 300 such that the lighting device housing maintains the folded position. The means for securing 300 can be any one of the aforementioned alternatives, wherein the snap and deformation fitting will require some amount of force when applied in order to "lock" the lighting device housing in the folded position, and the ultrasonic or thermal weld will require the tools during production to apply such an weld.

Figure 6:
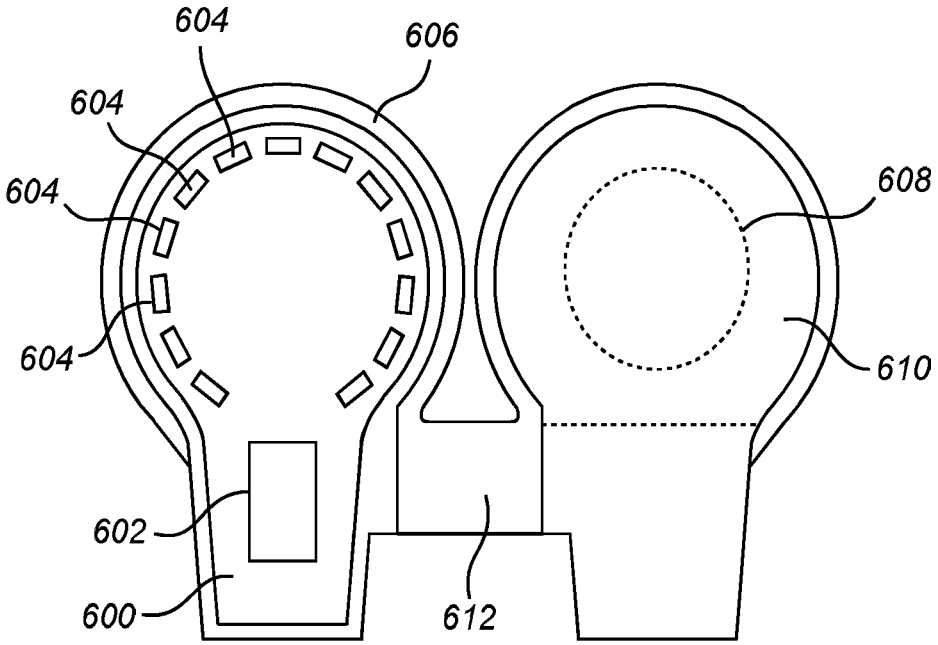
FIG. 6 is a cross-section of a lighting device according to an embodiment of the invention.

Referring now to FIG. 6, a schematic representation of an embodiment of the present invention is shown. According to the embodiment shown in FIG. 6, the light source(s) 604 and the driver electronics 602 are both arranged on a circuit board 600. By arranging both the light source(s) 604 and driver electronics 602 on a circuit board 600, the number of steps during assembly of the lighting device will be even further reduced. The printed circuit board 600 (PCB) therein is shaped as a cross section of a light bulb and is vertically aligned in the lighting device 100. The first and second portions of the lighting device housing are still configured to be folded about the connection portion 612. Furthermore, the PCB 600 arranged in the first portion of the lighting device housing includes both the LEDs 604 and the driver electronics 602, thereby further reducing the number of steps required for assembling the lighting device. The LEDs 604 may be placed on one or both sides of the PCB 600. Accordingly the PCB 600 may be provided in either one piece and configured to be foldable, or a first PCB (not shown) comprising the LEDs for one side and the driver electronics, and a second PCB (not shown) comprising LEDs 604 are mounted on the backside of the first PCB, thereby providing an even light distribution in all directions. Furthermore, in the embodiment shown in FIG. 6, an area 608 of the bulb portion may be used for an efficient thermal conduction from the lighting device housing to the surrounding environment. The other area of the bulb portion comprises an optically transmissive portion 610 which is transparent, but may also diffuse or wavelength convert light as described in connection to the above mentioned embodiments.

Figure 7:
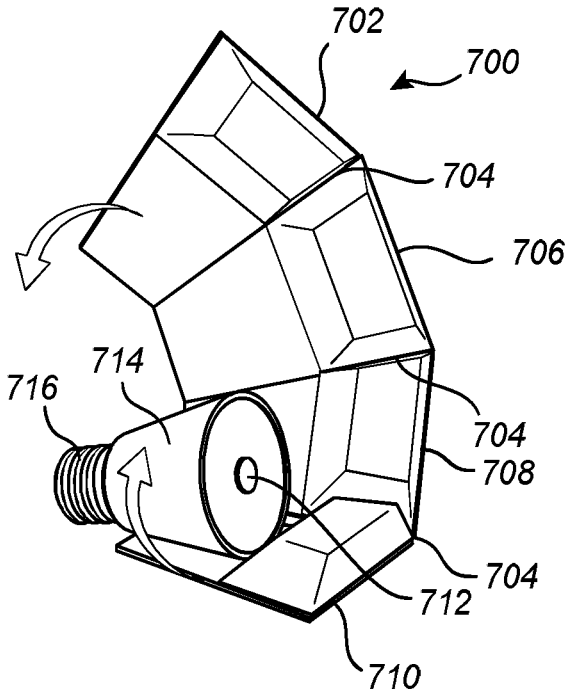
FIG. 7 is a perspective view of a lighting device according to another embodiment of the invention.

FIG. 7 is a perspective view of another embodiment of a lighting device according to the present invention. In FIG. 7, the lighting device housing 700 comprises a plurality of housing portions. The lighting device housing 700 may therefore be seen as a "folding blister" type of housing. In the embodiment shown in FIG. 7, the lighting device housing 700 comprises four housing portions, however, in principle, a smaller or greater number of housing portions is possible. The four housing portions 702, 706, 708, 710 are each connected to the adjacent housing portion by a flexible connection portion 704. The lighting device of FIG. 7 further comprises a light source 712, which after each housing portion has been folded about its connection portion, will be enclosed together with the driver electronics 714 in the lighting device housing 700. The lighting device also comprises a base portion 716 for connecting the driver electronics to a power source. The means for securing (not shown) will secure the adjacent housing portions 702 and 710 in the folded state of the lighting device housing 700 in order to maintain the folded state of the lighting device housing 700. It should be noted that the aforementioned features of certain types of means for securing, the means for diffusing and/or wavelength converting light may also advantageously be incorporated in the lighting device shown in FIG. 7.

Additionally, variations to the disclosed embodiments can be understood and effected by the skilled person in practicing the claimed invention, from a study of the drawings, the disclosure, and the appended claims. For example, the innovative lighting device is embodied in the drawings as a light bulb, however in principle any form or shape of lighting device that may be contemplated is possible to form according to the invention such as e.g. a tube lighting device. Furthermore, the lighting device housing portions shown in the figures is folded along a vertical plane. However, this should only be interpreted as an example, the lighting device housing may be folded just as well in a horizontal plane or in principle in any direction. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. A lighting device comprising:

a lighting device housing formed of an optically transmissive material and including an assembly aid portion, a light source arranged within said lighting device housing and mounted to a surface of the assembly aid portion, driver electronics configured to drive said light source, arranged within said lighting device housing in a compartment formed by the assembly aid portion opposite from the surface and the light source, wherein said lighting device housing comprises:

a first housing portion and a second housing portion connected to each other by a flexible connecting portion, said first housing portion being configured to be folded about said flexible connecting portion to enclose said light source and said driver electronics within said lighting device housing, and;

means for securing said first housing portion to said second housing portion to maintain said lighting device housing in a folded position, wherein said lighting device housing is formed in one piece and the assembly aid portion is formed as a wall extending transversely with respect to a socket portion of the housing across the first housing portion.

2. A lighting device according to claim 1, wherein said optically transmissive material is a thermo formable plastic.

3. A lighting device according to claim 1, wherein said optically transmissive material is transparent.

4. A lighting device according to claim 1, further comprising a heat spreader arranged within the lighting device housing and configured to conduct heat from said light source and/or driver electronics to said lighting device housing.

5. A lighting device according to claim 4, wherein said heat spreader-comprises a heat conducting foil and/or a preformed heat conductive element.

6. A lighting device according to claim 1, wherein said means for securing comprises an ultrasonic weld, a thermal weld, a snap fitting, and/or deformation fitting.

7. A lighting device according to claim 1, wherein said lighting device housing comprises diffusing elements configured to scatter light propagating through said lighting device housing.

8. A lighting device according to claim 1, wherein said lighting device housing comprises wavelength converting material.

9. A lighting device according to claim 7, wherein said diffusing elements are comprised in: a pattern printed on said transparent plastic material, a film laminated on said transparent plastic material and/or a material co-extruded with said transparent plastic material.

10. A lighting device according to claim 1, wherein said lighting device housing further comprises a removable hanger portion.

11. A lighting device according to claim 1, further comprising a base portion attached to an outside of said lighting device housing, and electrically connected to said driver electronics and configured to connect said lighting device to a power source.

12. A method for manufacturing a lighting device, said method comprising the steps of:

providing a sheet of optically transmissive plastic material, forming a lighting device housing from said sheet of optically transmissive plastic material, such that said lighting device housing comprises a first portion connected to a second portion by a flexible connecting portion and an assembly aid portion within at least one of the first and second portions, mounting a light source to a surface of the assembly aid portion, the assembly aid portion formed as a wall extending transversely with respect to a socket portion of the housing across the first portion;

positioning driver electronics in a compartment formed by the assembly aid portion opposite the surface and the light source, folding said first or second portion about said flexible connecting portion to enclose the light source and the driver electronics within an enclosed region of said lighting device housing, and securing said first portion to said second portion such that said lighting device housing maintains said folded position.

13. A method for manufacturing a lighting device according to claim 12, further comprising at least one of the steps of:

preprinting said optically transmissive plastic material, laminating said optically transmissive plastic material, and co-extruding said optically transmissive plastic material.

14. A lighting device according to claim 8, wherein said wavelength converting material is comprised in: a pattern printed on said transparent plastic material, a film laminated on said transparent plastic material and/or a material co-extruded with said transparent plastic material.

15. The method of claim 12, wherein the positioning includes positioning the driver electronics solely in the compartment and the method does not include positioning any driver electronics in the second portion.

16. The lighting device of claim 1, wherein the first housing portion includes the assembly aid portion to form the compartment in the first housing portion, the driver electronics are positioned wholly in the compartment, and the second housing portion does not include any driver electronics.

17. The lighting device of claim 1, wherein the light source is wholly included in the first housing portion and the second housing portion does not include any light sources.

18. A lighting device comprising:

a lighting device housing formed of an optically transmissive material and including an assembly aid portion, a light source arranged within said lighting device housing and mounted to the assembly aid portion, driver electronics configured to drive said light source, arranged within said lighting device housing in a compartment formed by the assembly aid portion opposite from the light source, wherein said lighting device housing comprises:

a first housing portion and a second housing portion connected to each other by a flexible connecting portion, said first housing portion being configured to be folded about said flexible connecting portion to enclose said light source and said driver electronics within said lighting device housing, and;

means for securing said first housing portion to said second housing portion to maintain said lighting device housing in a folded position, wherein said lighting device housing is formed in one piece, the first housing portion includes the assembly aid portion to form the compartment in the first housing portion, the driver electronics are positioned wholly in the compartment, and the second housing portion does not include any driver electronics.

* * * * *